US005690413A

United States Patent [19]

Coughlin

[11] Patent Number: 5,690,413

[45] Date of Patent: Nov. 25, 1997

[54] SAFETY LIGHT FOR MARINE VEST

[76] Inventor: James Coughlin, R.R. 1-Box 84, Hardin, Ill. 62047

[21] Appl. No.: 607,717

[22] Filed: Feb. 27, 1996

[51] Int. Cl.[6] ..... F21L 15/08; B63C 9/08; B63C 9/20

[52] U.S. Cl. ..... 362/108; 362/103; 362/184; 362/190; 362/191; 441/88; 441/89; 441/106

[58] Field of Search ..... 362/108, 103, 362/184, 190, 191, 197, 198, 199; 441/89, 88, 106

[56] References Cited

U.S. PATENT DOCUMENTS

| | | | |
|---|---|---|---|
| 2,070,818 | 2/1937 | Winckler | 441/89 |
| 2,275,765 | 3/1942 | Hummert | 362/108 |
| 2,724,769 | 11/1955 | D'Arbeloff | 362/108 |
| 3,621,501 | 11/1971 | Jordan | 441/89 |
| 3,798,692 | 3/1974 | Madeley | 441/89 |
| 4,060,867 | 12/1977 | Miller | 441/89 |
| 4,328,533 | 5/1982 | Paredes | 362/108 |
| 4,400,763 | 8/1983 | Kribs | 362/190 |
| 4,429,350 | 1/1984 | Guthrie | 362/190 |
| 4,967,323 | 10/1990 | Johnson | 362/190 |
| 5,029,293 | 7/1991 | Fontanille | 441/89 |
| 5,077,644 | 12/1991 | Schaller | 362/184 |
| 5,311,100 | 5/1994 | Brain | 441/89 |
| 5,326,297 | 7/1994 | Loughlin | 441/89 |
| 5,370,566 | 12/1994 | Mitchell, Jr. et al. | 441/89 |
| 5,424,922 | 6/1995 | Wise | 362/108 |
| 5,488,361 | 1/1996 | Perry | 362/103 |

*Primary Examiner*—Ira S. Lazarus
*Assistant Examiner*—Matthew Spark
*Attorney, Agent, or Firm*—Polster, Lieder, Woodruff & Lucchesi

[57] ABSTRACT

A safety light is provided which is removably securable to a marine safety vest. Marine safety vests commonly include a back panel and two front panels, each of which have a first side and a second side and at least one slot formed therein. The panels are connected by straps which are threaded through the slots. The safety light includes a lamp which is pivotally mounted to an outer surface of a first plate. A threaded shaft extends from the inner surface of the plate to extend through a slot of a front panel of a vest. A battery pack or other energy source is provided to power the lamp. A securing member is provided to be placed against the inner surface of the front panel and includes an internally threaded boss which receives the shaft of the first plate to secure the safety light to the vest.

20 Claims, 2 Drawing Sheets

SAFETY LIGHT FOR MARINE VEST

BACKGROUND OF THE INVENTION

This application relates to marine equipment, and in particular, to a safety light which may be secured to a marine vest.

Boats, such as tug boats, cargo vessels, etc., may have many obstacles, such as ropes, chains, pylons, etc. Although these items are generally carefully stowed, workers must nonetheless be careful as to where they step. These obstacles become more dangerous in the dark when they are hard to see. In the dark, boat workers must carry lights so that they can adequately see all the obstacles. It is also desirable for the worker to have both hands free. However, when he is carrying a light, only one hand is free.

SUMMARY OF THE INVENTION

One object of the present invention is to provide a light for a marine vest.

Another object is to provide such a light which may be easily secured to and removed from the vest.

Another object is to provide such a light which may be easily and economically produced.

These and other objects will become apparent to those skilled in the art upon reading the following disclosure in view of the accompanying figures.

In accordance with the invention, generally stated, a safety light is provided which is removably securable to a marine safety vest. Marine safety vests commonly include a back panel and two front panels, each of which have a first side and a second side and at least one slot formed therein. The panels are connected by straps which are threaded through the slots.

The safety light includes a lamp which is pivotally mounted to an outer surface of a first plate. A threaded shaft extends from the inner surface of the plate to extend through a slot of a from panel of the vest. A battery pack or other energy source is provided to power the lamp. A securing member is provided to be placed against the inner surface of the front panel to cooperate with the first locking member to secure the safety light to the vest. The securing member includes a plate having an inner surface from which a second locking member extends. The second locking member interacts with the first locking member to secure the light to the vest. The first and second locking members include a shaft and a boss which telescopes relative to the shaft. Preferably, the shaft and boss are threaded so that the shaft and the boss may be threadedly connected.

In one embodiment the lamp is mounted directly to the first plate and the battery pack is separate and secured to the back panel of the vest. In a second embodiment, the lamp is mounted to the battery pack and the battery pack, in turn, is mounted to the first plate. In either case, the lamp is preferably pivotal about a generally horizontal axis so that the lamp may be pivoted upwardly or downwardly.

In the first mentioned embodiment, the battery pack is electrically connected to the lamp by an electrical cable. The battery pack includes a housing having a back surface, a first locking member extending from the back surface to extend through a selected slot of the back panel. A securing member substantially identical to the above mentioned securing member secures the battery pack to the vest back panel. The securing member includes a plate having a second locking member extending therefrom to engage the locking member of the battery pack to secure the battery back to the vest back panel. The battery pack may also include a lamp or a reflector on an outer visible surface thereof to enable a wearer of the vest to be seen. The back panel of the vest may include two spaced apart slots near the top thereof. The battery pack is preferably sized to extend over both of the slots, and to include two locking members extending therefrom. A second securing member is provided for the battery pack to engage the second locking member of the battery pack.

In a second embodiment of the lamp itself, the lamp may include a first bulb and a second bulb. The first bulb emits light in a generally forwardly direction and the second bulb emits light generally downwardly direction.

DESCRIPTION OF THE PREFERRED EMBODIMENT

Figure 1:
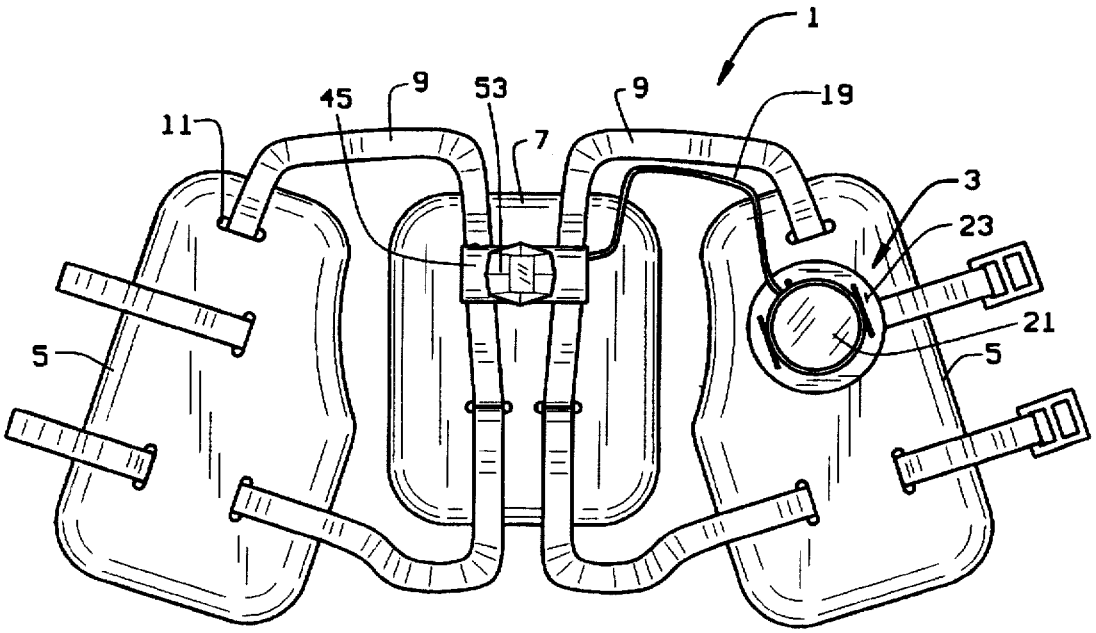
FIG. 1 is a plan view of the outer surfaces of a marine vest with a first embodiment of a light of the present invention.
Figure 2:
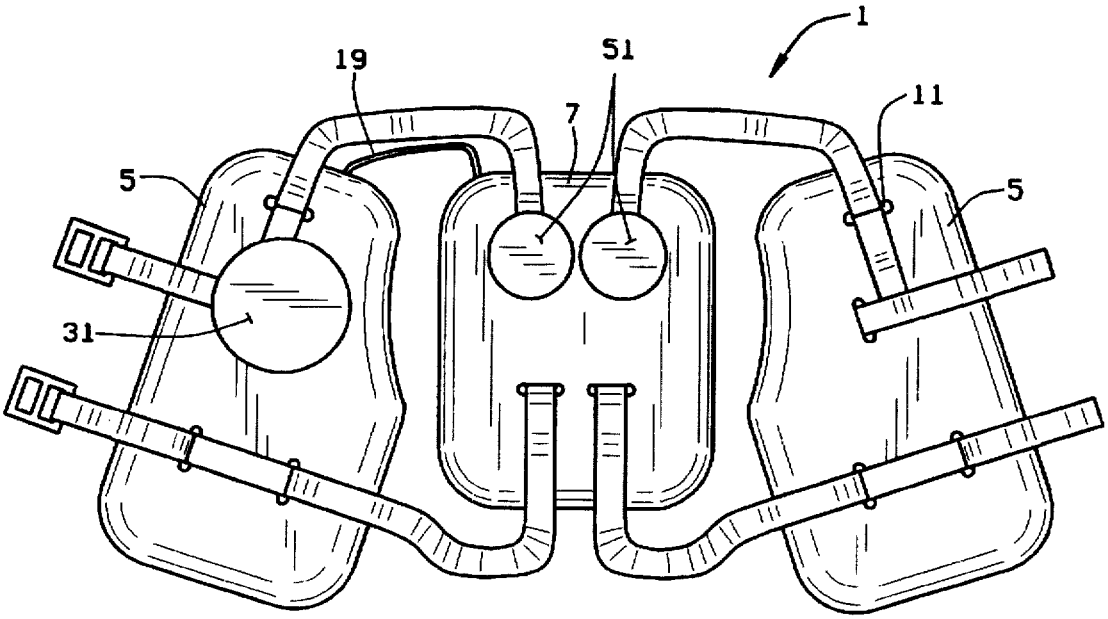
FIG. 2 is a plan view of the inner surfaces of the vest with the light.

A marine vest 1 with a light assembly 3 is shown in FIGS. 1 and 2. The marine vest 1 illustrated is a standard marine vest having two front panels 5 which are connected to a back panel 7 by a plurality of straps 9. Each panel includes an inner surface and an outer surface, the outer surface being the exposed surface when the vest is worn. The straps 9 pass through slits or openings 11 formed in the panels as is known. Buckles or other connectors are used to connect the front two panels 5 together to secure the vest 1 on a wearer.

Figure 3:
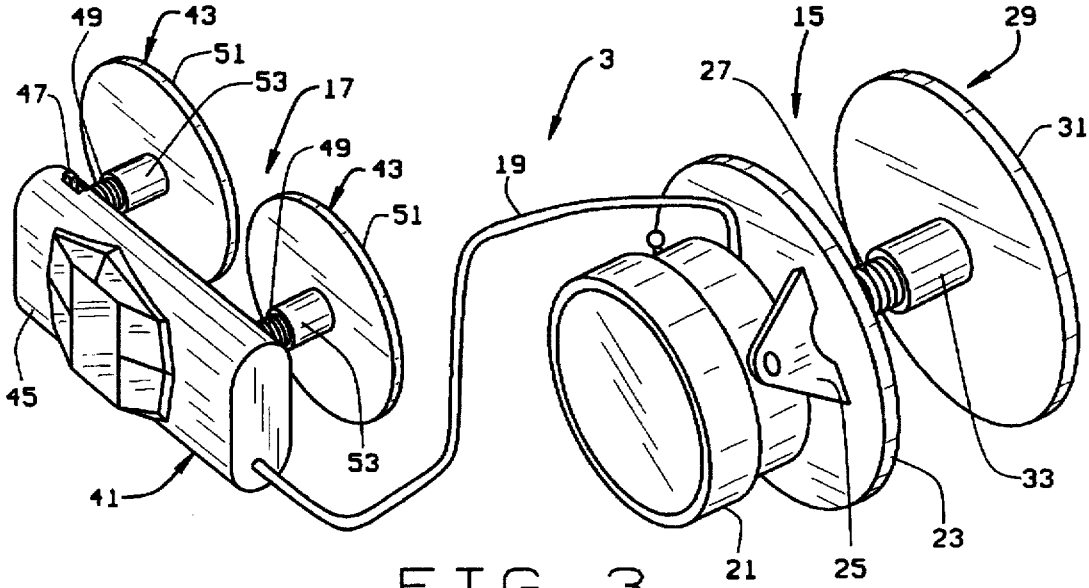
FIG. 3 is a perspective view of the light and battery pack.
Figure 4:
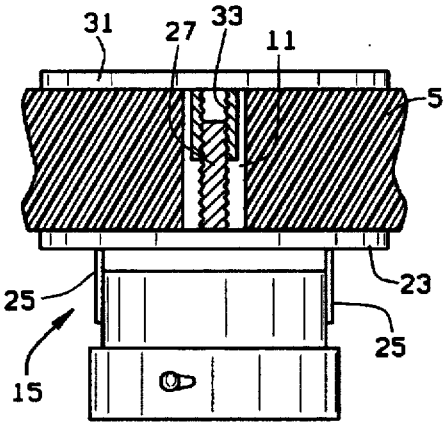
FIG. 4 is an enlarged elevational view of the light secured to the vest.
Figure 5:
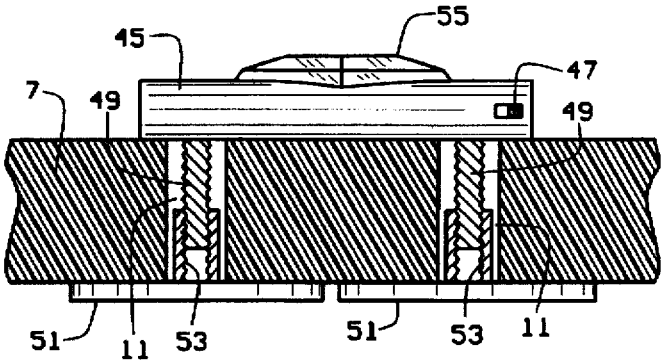
FIG. 5 is an enlarged elevational view of the battery pack secured to the vest.

The light assembly 3, best seen in FIG. 3, includes a lamp subassembly 15 and a battery subassembly 17 electrically connected by an electrical cable 19. The lamp subassembly 15 includes a lamp 21 mounted on a plate 23. Preferably, a pair of arms 25 extend from an outer surface of the plate 23 and the lamp 21 is mounted between the arms 25 to enable the lamp 21 to be swiveled or pivoted up and down. A threaded shaft 27 extends from the back of the plate 23. The lamp subassembly 15 also includes a securing member 29 which is used to secure the lamp 21 to the vest. The securing member 29 includes a plate 31 having a internally threaded boss 33 extending up from the plate 31. As seen in FIGS. 3 and 4, the shaft 27 from the plate 23 is received in the threaded boss 33. To mount the lamp subassembly 15 to the vest 1, the lamp 21 and plate 23 are placed against the outer surface of a selected front panel 5 of the vest with the shaft 27 extending into an slit 11 in the selected front panel 5. The securing member is placed against the inner surface of the same front panel with its boss 33 extending into the slot 11 to receive the shaft 27. The plate 31 of the securing member is then rotated to screw the boss 33 onto the shaft 27. The plates 23 and 31 clamp the vest, as seen in FIG. 4 to secure the light subassembly to the vest 1.

The battery subassembly 17 includes a battery compartment 41 and a pair of securing members 43. The battery compartment includes a battery housing 45 which contains batteries and includes an on/off switch 47. As can be appreciated, the electrical cable 19 electrically connects the batteries, the on/off switch and the lamp in an electrical circuit such that the batteries supply power to the lamp and the on/off switch may be used to operate the lamp 21. A pair of threaded shafts 49 extend from a rear surface of the battery housing 45. The securing members 43 are substantially similar to the securing member 29 of the lamp subassembly 15 and include a plate 51 having an upwardly extending and internally threaded boss 53. The shafts 49 are received in the bosses 53.

The back panel 7 of the marine vest 1 has have two spaced apart slits 11 near its top. The battery housing 45 is sized to span the space between the two slits and the shafts 49 are spaced apart a distance sufficient to allow each shaft 49 to extend through one of the two slits. The securing members 43 are applied to the inner surfaces of the back panel and extend through the slits so that the bosses 33 may be threaded onto the shafts 49. The electrical cable 19 extends from the housing 45 to the lamp 21 and is sufficiently long to prevent the electrical cable from being taught when applied to the vest. Preferably, the battery pack includes a reflector or low intensity light 55. Although the light 53 is not strong enough for the wearer to see by, it will enable him to be seen. Although one lamp subassembly 15 is shown, the safety light 3 could include two lamp assemblies, one for each front panel 5 of the vest 1.

Figure 6:
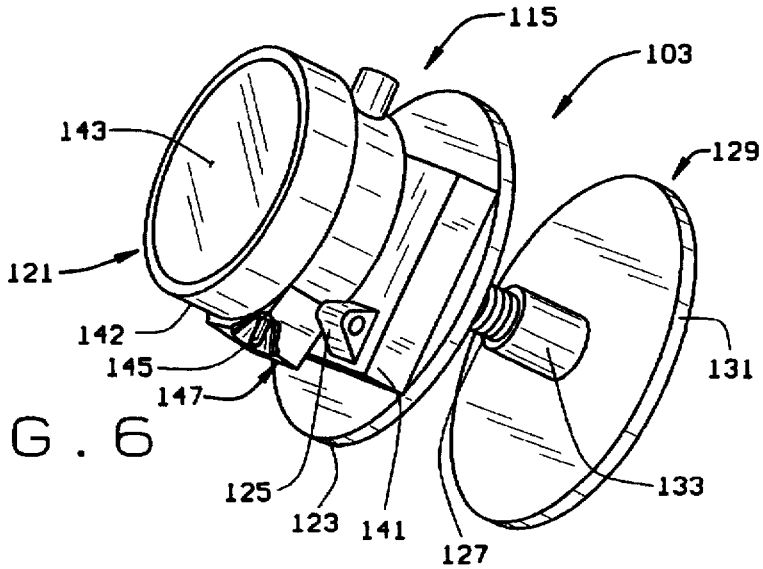
FIG. 6 is a perspective view, partly in cross-section, of a second embodiment of the light.

A second embodiment of the light is shown in FIG. 6. In this embodiment, the light assembly 103 is made of one piece instead of two pieces. The light assembly 103 includes a top or outer portion 115 which includes the lamp 121 and the battery pack 141. A pair of arms 125 are mounted to the top surface of the battery pack 141 and the lamp is secured to the arms 125 such that the lamp 121 may be swiveled or pivoted upwardly and downwardly. The battery pack 141, in turn, is mounted to a plate 123 having a rearwardly extending threaded shaft 127. The shaft 127 is received in the securing member 129 to secure the light assembly 103 to the vest. The securing member 129 is identical to the securing member 29 and includes a plate 131 and an upwardly extending internally threaded boss 133 which receives the shaft 127. The light assembly 103 is secured to the vest in the same manner as the light subassembly 15 of the safety light 3. This, second, embodiment has the advantage of eliminating the need for the electrical cable 19. However, it does not provide a place to mount a rear light or reflector to enable the wearer to be seen easily. Nor does it provide the capability of having two light.

The lamp 121 includes two bulbs. A first bulb (not shown) is housed in the main compartment 142 of the lamp 121 behind the lens 143. The first bulb emits light generally forwardly. A second bulb 145 is positioned at the bottom of the light housing 142 and is protected by an enclosure 147. The enclosure 147 includes an opening in its bottom through which light from the bulb shines. The bulb 145 thus shines light generally downwardly and at an angle of about 90° from the first bulb, to provide some light at the feet of the wearer. As can be seen, one bulb shines forwardly and the second shines downwardly. Thus, the wearer can look down without the need of swiveling the lamp 121.

As can be appreciated, the disclosed light assembly 121 is one which is easy to secure to, and remove from, the vest 1. When the light assembly is applied to a vest, the wearer will have both hands free to enable him to more easily perform his work and to navigate the obstacles on the deck of a boat or a dock. The arms, to which the lamp is pivotally mounted, frictionally hold the lamp, so that the lamp can be pivoted or swiveled to a desired position and maintain that position until changed again. The boss and shaft of the subassemblies define locking members to secure the light to the vest. The outer diameter of the boss is less than the width of the slit to allow for the space occupied by the strap 9 which will also pass through the slit. Although the slit 11 is wider than the boss of the securing members, the securing members, when interacting with the subassembly 15 or 115 will be tightened against the inner surface of the panel to frictionally hold the light assembly in place with respect to the slit. The light assembly therefore will not slide in the slot.

The above description is set forth for illustrative purposes only. Variations within the scope of the appended claims may be apparent to those skilled in the art. For example, the plates, although shown round, can be any desired shape. The shaft and boss can be switched, such that the shaft is part of the securing member and the boss extends from the lamp assembly plate or the battery housing. Other means of securing the lamp to the vest can also be used. The boss can be provided with a keyway and the shaft can be provided with a finger which extends though the keyway. With this embodiment, the boss is telescoped over the shaft and then rotated when the finger hits the bottom of the keyway to lock the light to the vest. A rib and detent combination can also be used. However, this may come apart too easily. In the embodiment of FIG. 6, the battery pack 141 and the plate 123 can be integrally formed as a one-piece unitary part, or as two separate parts which are secured together, such as by glue, for example. These examples are merely illustrative.

I claim:

1. In combination, a marine safety vest and a safety light which is removably mounted to the safety vest; the safety vest including a back panel and two front panels, each of said panels having a first side and a second side and at least one slot formed therein, said panels being connected by straps which are threaded through said slots; said safety light including:

a first plate positioned against said first side of a selected one of said front panels; said first plate including a front surface, a back surface, and a first post extending from said back surface of said first plate, said first post extending through a slot of said selected front panel;

a lamp mounted on said front surface of said first plate;

a securing member including a second plate having a front surface, a back surface, and a second post extending from said back surface of said second plate through said slot of said selected front panel, said first and second posts mating with each other to mount said safety light to said vest; and a battery pack assembly electrically connected to said lamp.

2. The combination of claim 1 wherein said lamp is pivotally mounted to said first plate.

3. The combination of claim 2 wherein said battery pack assembly is mounted to said front surface of said first plate and said lamp is mounted to said battery pack assembly.

4. The combination of claim 1 wherein said first post comprises one of an externally threaded rod and an internally threaded boss and said second post comprises the other of said externally threaded rod and said internally threaded boss, said externally threaded rod being received in the internally threaded boss to removably mount said light assembly to said vest.

5. The combination of claim 1 wherein said battery pack assembly is removably mounted to said back panel of said vest, said safety light including an electrical cable to electrically connect said battery pack to said lamp; said battery pack assembly including a housing and a battery pack mounting plate; said housing having a back surface and a first post extending from said housing back surface to extend through a selected slot of said back panel; and said battery pack mounting plate having a second post extending therefrom to engage said battery pack assembly first post to mount said battery back assembly to said vest back panel.

6. The combination of claim 5 wherein one of a low intensity light and a reflector is mounted on an outer visible surface of said battery pack housing to enable a wearer of the vest to be seen from behind.

7. The combination of claim 5 wherein said back panel includes two spaced apart slots near the top thereof, said battery pack housing being sized to expand across both said slots, said battery pack assembly including a third post spaced from said first battery pack assembly post such that said first and third battery pack assembly posts extend through said slots and a second mounting plate, said second mounting plate including a fourth battery pack assembly post, said second and fourth battery pack assembly posts mating with each other to mount said battery pack assembly to said vest back panel.

8. The combination of claim 1 wherein said lamp includes a first bulb and a second bulb; said first bulb emitting light in a generally forwardly direction and said second bulb emitting light generally downwardly.

9. A safety light assembly adapted to be removably mounted to a marine safety vest; the safety vest having a back panel and two front panels, each of said panels having a first side and a second side and at least one slot formed therein, said panels being connected by Straps which are threaded through said slots; said safety light assembly comprising:

a first plate including a front surface and a back surface and a first locking member extending from said back surface;

a lamp mounted on said front surface of said first plate;

a securing member including a second plate having a front surface, a back surface, and a second locking member extending from said back surface of said second plate said first and second locking members cooperating with each other to secure said safety light assembly to the vest; and a battery pack electrically connected to said lamp.

10. The safety light of claim 9 wherein said lamp is pivotally mounted to said first plate.

11. The safety light of claim 10 wherein said battery pack is mounted to said front surface of said first plate and said lamp is mounted to said battery pack.

12. The safety light of claim 9 wherein said first locking member is one of an externally threaded rod and an internally threaded boss, and said second locking member is the other of said externally threaded rod and an internally threaded boss.

13. The safety light of claim 9 wherein said battery pack is adapted to be removably mounted to said back panel of said vest, said safety light assembly including an electrical cable to electrically connect said battery pack to said lamp; said battery pack including a housing having a back surface, a first locking member extending from said back surface to extend through a selected slot of said back panel; and a securing member including a plate having a second locking member extending therefrom to engage said locking member of said battery pack housing to secure said battery back to said vest back panel.

14. The safety light of claim 13 wherein one of a low intensity light and a reflector is mounted on an outer visible surface of the battery pack housing to enable a wearer of the vest to be seen from behind.

15. The safety light of claim 13 wherein said battery pack includes a third locking member spaced from said first locking member and a second securing member, said second securing member including a second plate and a fourth locking member, said second and fourth locking members cooperating to mount said battery pack to the vest back panel.

16. The safety light of claim 9 wherein said lamp includes a first bulb and a second bulb; said first bulb emitting light in a generally forwardly direction and said second bulb emitting light in a generally downwardly direction.

17. In combination, a marine safety vest and a safety light mounted to the safety vest; the safety vest including a back panel and two front panels, each of said panels having a first side and a second side and at least one slot formed therein, said panels being connected by straps which are threaded through said slots; said safety light including:

a first plate which is positionable against said first side of a selected one of said front panels; said first plate including a front surface, a back surface, and a first post extending from said back surface of said first plate and into a selected slot of said selected from panel;

a second plate having a front surface, a back surface, and a second post extending from said back surface of said second plate and into said selected slot of said selected front panel, said first and second posts engaging each other to mount said safety light to said vest, said first post comprising a threaded shaft and said second post comprising an internally threaded boss which receives said first post;

a lamp pivotally mounted on said front surface of one of said first plate and second plates; and a battery pack mounted on said vest and electrically connected to said lamp.

18. The combination of claim 17 wherein said battery pack is mounted to said back panel of said vest, said safety light including an electrical cable to electrically connect said battery pack to said lamp; said battery pack including a housing having a back surface, a pair of spaced apart posts extending from said housing back surface to extend into said back panel; and a pair of battery pack mounting plates, each said battery pack mounting plate having a mounting plate post, said mounting plate posts engaging said battery pack housing posts to mount said battery back to said vest back panel.

19. A safety light assembly adapted to be mounted to a safety vest; said safety light assembly including:

a first plate comprising a front surface, a back surface, and a first post extending from said back surface;

a second plate having a front surface, a back surface, and a second post extending from said back surface of said second plate; said first and second posts engaging with each other to mount said safety light to said vest;

a lamp pivotally mounted on said front surface of one of said first plate and second plates; and a battery pack electrically connected to said lamp.

20. The safety light assembly of claim 19 wherein said battery pack and said lamp are independently mounted to said vest, said safety light assembly including an electrical cable to electrically connect said battery pack to said lamp; said battery pack including a housing and a mounting plate, said housing having a back surface and a post extending from said housing back surface; said mounting plate having a mounting plate post which engages said housing post to mount said battery back to said vest back panel.

* * * * *